US005135389A

United States Patent [19]

Dai et al.

[11] Patent Number: 5,135,389

[45] Date of Patent: Aug. 4, 1992

[54] HANDY GAS TORCH

[76] Inventors: Tony J. J. Dai, No. 7, Alley 51, Lane 136, Syh-Der Rd., Wuh-Feng Shiang, Taijong Shine; Jeh W. T. Lin, No. 30 Sec. 1, Shiow-Laang Rd., Yeong-Ho City, Taipei, both of Taiwan

[21] Appl. No.: 784,591

[22] Filed: Oct. 29, 1991

[51] Int. Cl.[5] ..... F23D 14/12

[52] U.S. Cl. ..... 431/328; 431/329; 431/344; 126/413; 126/403; 126/406

[58] Field of Search ..... 431/344, 328, 329; 126/403, 406, 408, 410, 413

[56] References Cited

U.S. PATENT DOCUMENTS

| | | | |
|---|---|---|---|
| 4,641,632 | 2/1987 | Nakajima | 126/406 |
| 4,966,128 | 10/1990 | Wang et al. | 126/413 |
| 5,007,405 | 4/1991 | Hsu | 126/413 |

*Primary Examiner*—Carroll B. Dority
*Attorney, Agent, or Firm*—Bacon & Thomas

[57] ABSTRACT

A handy gas torch controlled by a valve control mechanism to eject gas into a combustion chamber inside a nozzle for burning, said valve control mechanism comprising a valve control sleeve having a bearing plate fastened therein, a gas tube inserted through said bearing plate, said gas tube having a valve attached thereto at the bottom and stopped at a valve port through which gas is discharged out of a gas tank, a screw nut screwed up with said gas tube at the top above said bearing plate, a guide member mounted on said screw nut at the top, and spring means constantly forcing said valve to stop at said valve port. Moving said valve control sleeve causes said valve to disconnect from said valve port for discharging gas out of said gas tank into said nozzle for combustion. Releasing upward pressure from said valve control sleeve causes said valve to stop said valve port again. Said nozzle comprises a combustion tube having a commutator fastened therein through which a very hot flame is produced for welding. A catalyst may be fastened in said nozzle spaced from said commutator with a jet combustion chamber defined therebetween so that a heat flow can be produced therethrough for melting a stick of glue or for drying purpose.

8 Claims, 5 Drawing Sheets

HANDY GAS TORCH

BACKGROUND OF THE INVENTION

The present invention relates to gas torches and relates more particularly to a handy gas torch for welding operation which is generally comprised of a gas tank, a gas flow rate control mechanism and a combustion mechanism. Flow of gas is discharged out of the gas tank for burning when the gas flow rate control mechanism is moved to an upper limit position, or stopped from discharging out of the gas tank when the gas flow rate control mechanism is moved back to its original position.

According to the known structure of gas torch, gas flow rate is generally controlled by a piston-like mandrel. This common disadvantage of this structure of gas torch is that the mandrel may be worn off easily causing gas leakage problem. Further, the gas flow rate control mechanism must be accurately turned off to close the gas passage after each use. If the gas glow rate control mechanism is not accurately turned off, gas leakage problem may happen. Because a gas torch is operated to produce a very hot flame, it is not suitable for use as an air dryer. Further, the known structure of gas torch is not suitable for use as a glue gun to melt a glue stick for sealing or for soften an acrylic sheet permitting it to be bent into the desired shape.

SUMMARY OF THE INVENTION

The present invention has been accomplished under the circumstances in view. According to one aspect of the present invention, a handy gas torch is generally comprised of a gas tank controlled by a gas flow control mechanism to discharge gas into a combustion chamber in a nozzle for burning, which gas flow control mechanism comprises a valve control sleeve having a bearing plate fastened therein, a gas tube inserted through said bearing plate, said gas tube having a valve attached thereto at the bottom and stopped at a valve port on a cap fastened in said gas tank at the top, a screw nut screwed up with said gas tube at the top above said bearing plate, and a guide member mounted on said screw nut at the top, wherein moving said valve control sleeve causes said valve to disconnect from said valve port for discharging gas out of said gas tank into said nozzle for combustion; releasing upward pressure from said valve control sleeve causes said valve to stop said valve port again. Because friction between parts is eliminated, the service life of the parts thereof is extended and, gas leakage problem is prevented when not in use.

According to another aspect of the present invention, the handy gas torch further comprises a first compression spring sleeved on the gas tube and retained between a flame regular screw and a collar on the gas tube, and a second compression spring retained between the guide member and a heat radiation tube, wherein said first and second compression springs automatically force the valve control sleeve and the gas tube to move back to their original positions permitting the valve to stop at the valve port again once the upward pressure is released from the valve control sleeve.

According to still another aspect of the present invention, the nozzle of the handy gas torch is comprised of a casing having a commutator and a catalyst fastened therein with a jet gas combustion chamber defined between said commutator and said catalyst, therefore, heat flow can be blown through the catalyst for melting a glue stick or for drying purpose.

DETAILED DESCRIPTION OF THE PREFERRED EMBODIMENT

Figure 1:
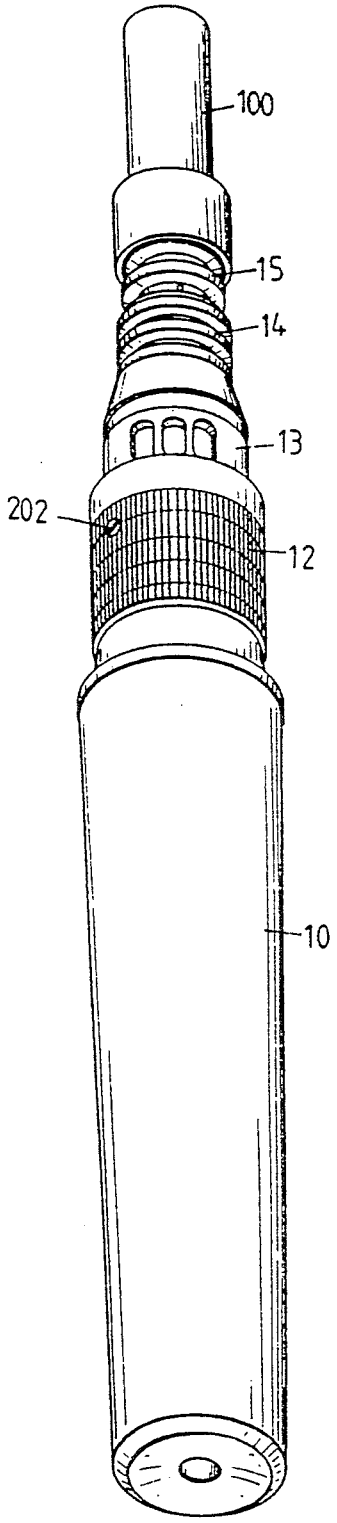
FIG. 1 is an elevational view of the preferred embodiment of the handy gas torch of the present invention.
Figure 2:
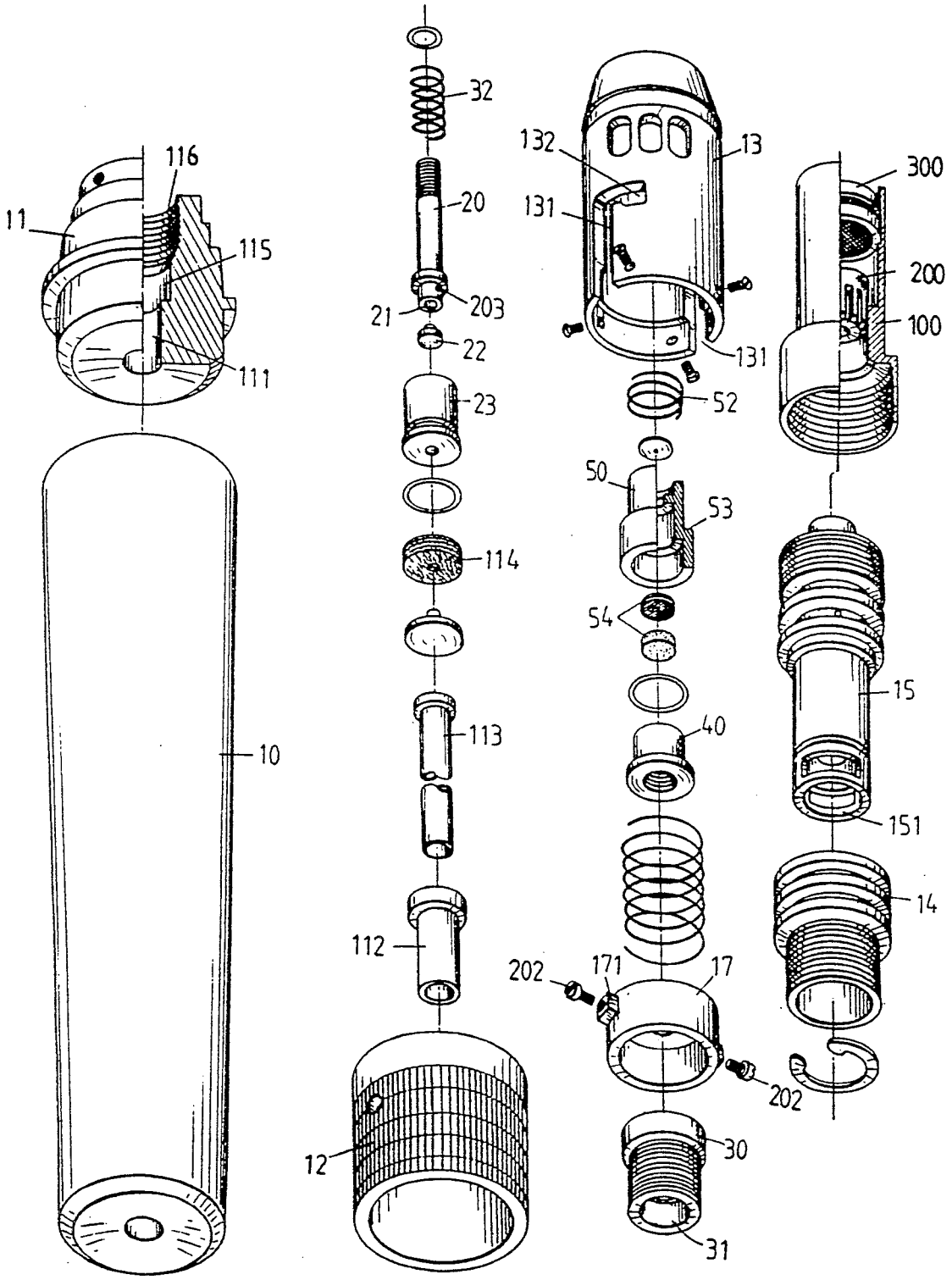
FIG. 2 is an exploded perspective view thereof.
Figure 3:
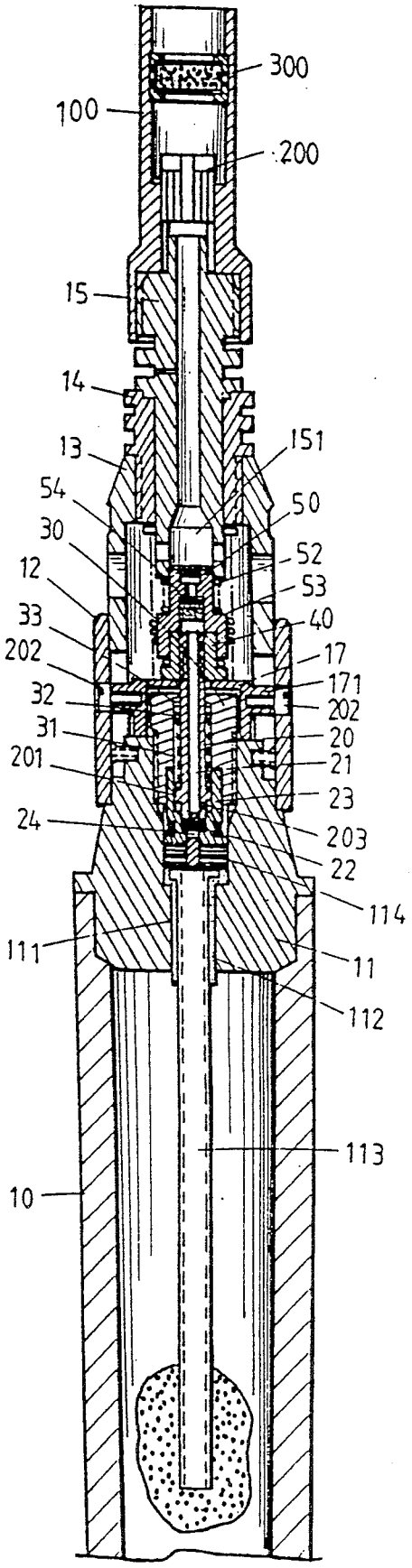
FIG. 3 is a sectional view thereof taken in longitudinal direction showing that the gas passage therein is closed.

Turning now to the annexed drawings in detail and referring first to FIGS. 1, 2 and 3, therein illustrated is a handy gas torch embodying the present invention which is generally comprised of a cylindrical gas tank 10, a valve control sleeve 12, a sleeve holder 13, a heat-insulating socket 14, a heat radiation tube 15, and a nozzle 100. The valve control sleeve 12 has a bearing plate 17 fastened therein by screws 202 for holding a gas tube 20. The gas tube 20 has a boring bore 21 through the central axis thereof releasably closed by a substantially T-shaped valve 22 at the bottom. The T-shaped valve 22 is disposed in an inverted position with the top edge thereof inserted in the boring bore 21 of the gas tube 20 from the bottom and with the broad bottom edge stopped against the gas outlet of the gas tank 10. The cap 11 has a through-hole 111, a recessed hole 115 and a bolt hole 116 longitudinally aligned through the central axis thereof, wherein the through-hole 111 is made on the bottom edge thereof, the bolt hole 116 is made on the top edge thereof, and the recessed hole 115 is connected therebetween. The through-hole 111 is relatively smaller in diameter than the recessed hole 115 and the bolt hole 116, having a holder 112 fastened therein for holding a suction tube 113 which has a bottom end inserted into the gas tank 10 and a top end attached with a sponge filter or the like 114. A valve seat 23 is set in the recessed hole 115 and firmly stopped against the sponge filter 114, having a valve port 24 blocked by the valve 22. A flame regulator screw 30 which has a center hole 31 through the central axis thereof is screwed into the bolt hole 116. Before fastening the flame regulator screw 30 in the bolt hole 116 on the cap 11, a compression spring 32 is sleeved on the gas tube 20. The gas tube 20 has a collar 201 around the peripheral surface thereof at a lower position. The flame regulator screw 30 has an inward projection 33 at the top. Therefore, once the flame regulator screw 30 is screwed into the bolt hole 116 on the cap 11, the compression spring 32 is stopped between the collar 201 on the gas tube 20 and the inward projection 33 on the flame regulator screw 30. After assembly, the flame regulator screw 30 is disposed below the bearing plate 17. On the top of the bearing plate 17 there is provided a T-shaped screw nut 40 fastened on the externally threaded top end of the gas tube 20 in an inverted position for holding a guide member 50 which has a shoulder portion 53 at the bottom and is inserted in a hole 151 on the heat-radiation tube 15 permitting a compression spring 52 to be retained between the bottom shoulder portion 53 of the guide member 50 and the bottom edge of the heat-radiation tube 15.

Referring to FIG. 3 again, the valve control sleeve 12 is disposed at a lower limit position, when the gas torch is not in use, permitting the valve 22 to block up the valve port 24, and therefore, no gas will eject from the gas tank 10. Once the valve control sleeve 12 is pulled upwards and fixed in position, gas flow rate can be regulated by means of the operation of the screws 202, the side blocks 171 on the bearing plate 17 and two opposite longitudinal grooves 131 and two opposite latitudinal grooves 132 on the socket holder 13 (see FIG. 2 again).

Figure 4:
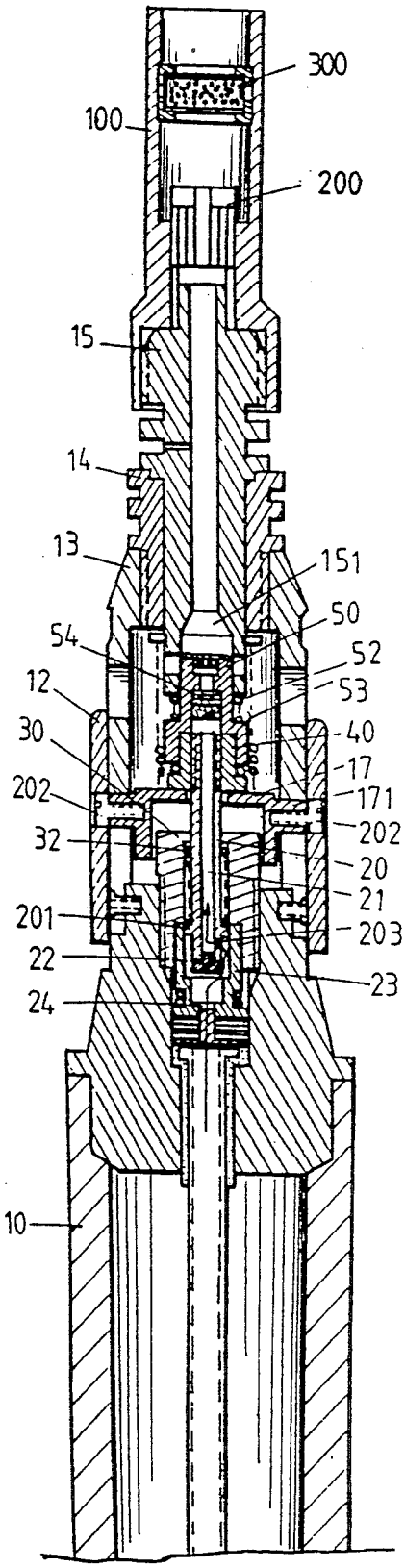
FIG. 4 is another sectional view thereof taken in longitudinal direction showing that the gas passage therein is opened.

Referring to FIG. 4, when the valve control sleeve 12 is pulled upwards to carry the bearing plate 17, the screw nut 40 and the guide member 50 are simultaneously moved upwards to squeeze the compression spring 52. Because the screw nut 40 is screwed up with the gas tube 20, the gas tube 20 is simultaneously carried upwards to squeeze the other compression spring 32, and therefore, the valve 22 is released from the valve port 24 to let gas blow out of the gas tank 10. Blown gas immediately passes through the valve port 24, a pivot hole 203 on the gas tube 20 below the flange 201 into the boring bore 21 of the gas tube 20, and then, passes through a hole (not shown) on the guide member 50 and the sponge filter 54 to further blow through the heat-radiation tube 15 out of a commutator 200 in the nozzle 100 for producing a fire to heat a bit for welding operation. A catalyst 300 may be fastened in the nozzle 100 in front of the commutator 200 so that the gas torch can be used as a glue gun or air dryer (This will be described further).

When to close up the gas torch, the valve control sleeve 12 is rotated to carry the screws 202 out of the latitudinal grooves 132, and therefore, the compression springs 52, 32 immediately force the valve control sleeve 12 to move downwards to its original position. Once the valve control sleeve 12 is moved back to its original position, the connected parts are moved back to seal the valve port 24.

Figures 5, 6:
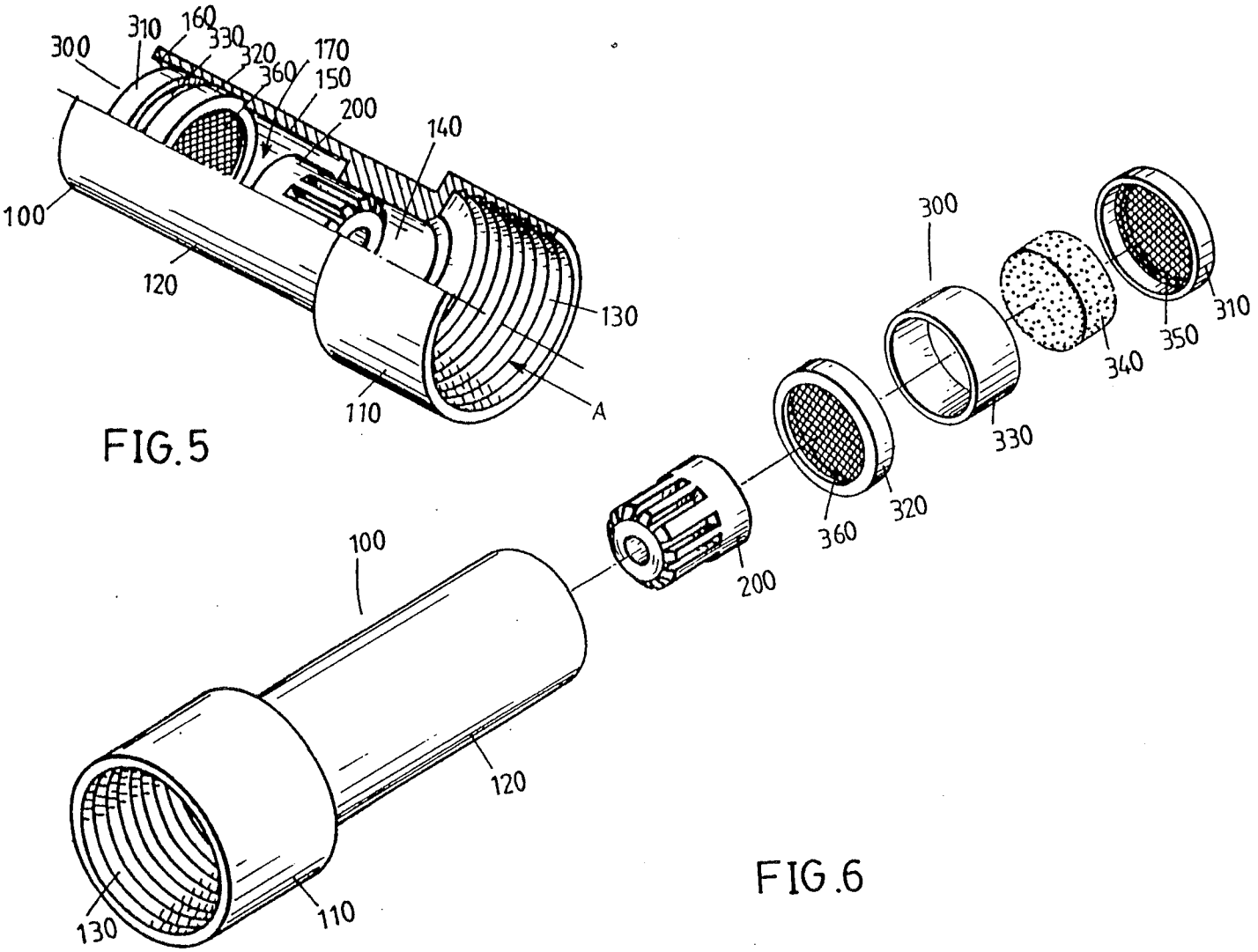
FIG. 5 is a sectional view of the nozzle in an enlarged scale.
FIG. 6 is an exploded perspective view of the nozzle.

Referring to FIGS. 5 and 6, the nozzle is comprised of a rear connecting end 110 and a front combustion tube 120. In the present preferred embodiment, the connecting end 110 has an inner thread 130 by which it can be fastened on the heat-radiation tube 15 through screw joint. The combustion tube 120 defines therein a reduced boring bore 140 at the bottom end thereof adjacent to the connecting end 110, a combustion chamber 150 at the middle in diameter slightly larger than said reduced boring bore 140, and a spout 160 at the front in diameter slighter larger than said combustion chamber 150.

As illustrated in FIG. 5, a commutator 200 is fastened in between the reduced boring bore 140 and the combustion chamber 150 and a catalyst 300 is fastened in spout 160 and spaced from the commutator 200. Therefore, a jet gas combustion chamber 170 is defined between the commutator 200 and the catalyst 300. As illustrated in FIG. 6, the catalyst 300 is comprised of a ring 300 having a heat absorbing medium 340 retained therein and two caps 310, 320 covered thereon at two opposite ends, which caps 310, 320 each is comprised of a wire gauze filter 350 or 360.

Referring to FIG. 5 again, when gas flows in direction A into the bolt hole 130, it is burnt to produce a flame in the jet gas combustion chamber 170 for heating the catalyst 300. By means of the effect of gas pressure, a heat flow is therefore blowing through the spout 160.

As indicated, gas flow is controlled by means of moving the valve 22 on the bottom end of the gas tube 20 to block up or release from the valve port 24 on the valve seat 23. Because no friction force will produce while turning on/off the gas tank 10, the gas torch of the present invention is more durable in use. Once the screws 202 are respectively moved out of the latitudinal grooves 231, the compression springs 32, 52 automatically push the valve control sleeve 12 back to its original position, so that the valve port 24 on the valve seat 23 can be automatically sealed by the valve 22 again. Therefore, no gas leakage problem will happen when the gas torch is not in use. Further, the nozzle 100 can be attached to any gas fixture for regulating the flow rate of discharged gas, and the intensity of flame or heat flow can be controlled. Therefore, the gas fixture to which the nozzle 100 is attached can be used as a glue gun, air dryer or hair dressing tool.

What is claimed is:

1. A gas torch of the type comprising a cylindrical gas tank covered with a cap for producing a very hot flame through a nozzle for welding operation, the improvement comprising:

a valve control sleeve mounted on said cap for said gas tank at the top, said valve control sleeve having holes at opposite locations;

a bearing plate fastened in said valve control sleeve by two screws screwed into said two holes;

a gas tube vertically inserted through said bearing plate, said gas tube having a bore through the central axis thereof, a collar adjacent to the bottom end thereof, and a gas passage hole on the outer wall thereof at a location below said collar;

a valve sealed in the bore of said gas tube at the bottom;

a valve seat fastened in a hole on said cap for said gas tank, said valve seat having a valve port for the passing therethrough of the flow of gas from said gas tank, said valve port being releasably stopped by said valve;

a hollow flame regulator screw sleeved on said gas tube, retained in said bearing plate and screwed into a bolt hole on said cap for said gas tank for holding said valve seat in place, said hollow flame regulator screw having an inward flange on the top edge thereof;

a first compression spring sleeved on said gas tube, received inside said flame regulator screw and retained between said collar on said gas tube and said inward flange on said flame regulator screw;

a screw nut screwed up with said gas tube at the top and disposed above said bearing plate;

a guide member mounted on said screw nut for guiding it in position, said guide member having a shoulder portion at the bottom;

a sleeve holder secured to said cap for said gas tank for holding said valve control sleeve in place, said sleeve holder having two curved grooves on the outer wall thereof at two opposite locations;

a heat insulating socket fastened in said sleeve holder at the top;

a heat radiation tube fastened in said heat insulating socket at the top for holding a nozzle;

a second compression spring retained between said shoulder portion of said guide member and the bottom edge of said heat radiation tube; and wherein moving said valve control sleeve upwards and rotating it through a fixed angle causes the two screws thereon to be engaged into said two curved grooves on said sleeve holder at an upper limit position so that said valve is released from said valve port for the passing therethrough of the gas from said gas tank; rotating said valve control sleeve backwards causes the screws thereon to be disengaged from said upper limit position so that the valve is pressed on said valve port to stop the gas from said gas tank.

2. The gas torch of claim 1, wherein said nozzle has a commutator fastened therein through which burning gas is guided to heat a bit at the front end thereof for a welding process.

3. The gas torch of claim 1, wherein said nozzle has a commutator fastened therein and a catalyst attached thereto at the front end thereof through which a heat flow is produced for air drying purpose.

4. The gas torch of claim 1, wherein said cap for gas tank has a through-hole, a recessed hole and a bolt hole longitudinally aligned through the central axis thereof, said through-hole being made on the bottom edge thereof for inserting a suction tube to guide gas out of said gas tank, said bolt hole being made on the top edge thereof for fastening said flame regulator screw, said recessed hole being connected between said through-hole and said bolt hole for holding said valve seat.

5. The gas torch of claim 1, wherein said valve is made from a stepped block having a thinner top end inserted into the bore in said gas tube and a wider bottom end stopped at said valve port on said valve seat.

6. The gas torch of claim 1, wherein said nozzle is comprised of a casing having a commutator and a catalyst fastened therein, said casing being comprised of a rear connecting end for connecting to a gas fixture and a front combustion tube, said combustion tube defining therein through the central axis thereof a reduced boring bore at one end adjacent to said rear connecting end, a combustion chamber at the middle in diameter slightly larger than said reduced boring bore, and a spout at an opposite end in diameter slighter larger than said combustion chamber, said commutator being fastened in between said reduced boring bore and said combustion chamber, said catalyst being fastened in said spout and spaced from said commutator with a jet gas combustion chamber defined therebetween.

7. The gas torch of claim 6, wherein said commutator has one part inserted in said reduced boring bore and an opposite part projecting into said combustion chamber.

8. The gas torch of claim 6, wherein said catalyst is comprised of a ring having a heat absorbing medium retained therein and two coverings covered thereon at two opposite ends, said two coverings each being comprised of a wire gauze filter.

* * * * *